US011411321B2

(12) United States Patent
Lasiter et al.

(10) Patent No.: US 11,411,321 B2
(45) Date of Patent: Aug. 9, 2022

(54) BROADBAND ANTENNA SYSTEM

(71) Applicant: QUALCOMM Incorporated, San Diego, CA (US)

(72) Inventors: Jon Lasiter, Stockton, CA (US); Donald William Kidwell, Jr., Los Gatos, CA (US); Ravindra Vaman Shenoy, Dublin, CA (US); Mohammad Ali Tassoudji, San Diego, CA (US); Jeremy Darren Dunworth, La Jolla, CA (US); Vladimir Aparin, San Diego, CA (US); Yu-Chin Ou, San Diego, CA (US); Seong Heon Jeong, Tuscaloosa, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 16/704,405

(22) Filed: Dec. 5, 2019

(65) Prior Publication Data

US 2021/0175636 A1 Jun. 10, 2021

(51) Int. Cl.

| | |
|---|---|
| ***H01Q 21/00*** | (2006.01) |
| ***H01Q 21/06*** | (2006.01) |
| ***H01Q 9/28*** | (2006.01) |
| ***H01Q 21/26*** | (2006.01) |
| *H01Q 1/48* | (2006.01) |

(52) U.S. Cl.

CPC ..... *H01Q 21/062* (2013.01); *H01Q 9/285* (2013.01); *H01Q 21/26* (2013.01); *H01Q 1/48* (2013.01)

(58) Field of Classification Search

CPC ..... H01Q 21/062; H01Q 9/285; H01Q 21/26; H01Q 1/48

USPC ..... 343/794

See application file for complete search history.

(56) References Cited

U.S. PATENT DOCUMENTS

| | | | | |
|---|---|---|---|---|
| 6,052,098 | A * | 4/2000 | Killen | H01Q 9/285 343/795 |
| 6,195,062 | B1 * | 2/2001 | Killen | H01Q 9/285 343/795 |
| 6,342,866 | B1 | 1/2002 | Ho et al. | |
| 6,407,717 | B2 * | 6/2002 | Killen | H01Q 9/285 343/795 |
| 7,365,698 | B2 * | 4/2008 | Dwyer | H01Q 1/38 343/792 |
| 7,683,849 | B2 * | 3/2010 | Schadler | H01Q 3/26 343/814 |

(Continued)

OTHER PUBLICATIONS

International Search Report and Written Opinion—PCT/US2020/063050—ISA/EPO—dated Feb. 22, 2021.

*Primary Examiner* — Jean B Jeanglaude

(74) *Attorney, Agent, or Firm* — Qualcomm Incorporated

(57) ABSTRACT

An antenna system includes: a ground conductor; a substrate; a pair of planar dipole conductors disposed such that at least a portion of the substrate is disposed between the ground conductor and the pair of dipole conductors; a pair of energy couplers each electrically connected to a respective one of the pair of dipole conductors; and a pair of isolated lobes including electrically-conductive material. The pair of isolated lobes are electrically separate from the pair of dipole conductors and the pair of energy couplers, and disposed between the pair of dipole conductors and the ground conductor.

20 Claims, 12 Drawing Sheets

(56) References Cited

U.S. PATENT DOCUMENTS

| | | | | |
|---|---|---|---|---|
| 8,319,688 | B2 * | 11/2012 | Parsche | H01Q 13/18 343/700 MS |
| 8,350,774 | B2 * | 1/2013 | Pickles | H01Q 9/16 343/795 |
| 8,643,554 | B1 | 2/2014 | Manry, Jr. et al. | |
| 9,331,388 | B2 | 5/2016 | Lindenmeier et al. | |
| 9,425,495 | B2 * | 8/2016 | Walker | H01Q 1/007 |
| 10,886,621 | B2 * | 1/2021 | Tanaka | H01Q 1/48 |
| 2001/0050654 | A1 * | 12/2001 | Killen | H01Q 5/49 343/817 |
| 2010/0207829 | A1 * | 8/2010 | Parsche | H01Q 13/18 343/732 |
| 2010/0271280 | A1 * | 10/2010 | Pickles | H01Q 9/16 343/858 |
| 2014/0218258 | A1 * | 8/2014 | Walker | H01Q 1/007 343/848 |
| 2015/0123868 | A1 | 5/2015 | Bit-Babik et al. | |
| 2015/0123869 | A1 | 5/2015 | Bit-Babik et al. | |
| 2015/0155630 | A1 | 6/2015 | Jiang et al. | |
| 2018/0040955 | A1 | 2/2018 | Vouvakis et al. | |
| 2018/0277956 | A1 | 9/2018 | Zhang | |
| 2019/0123425 | A1 | 4/2019 | Jeong et al. | |
| 2019/0181547 | A1 | 6/2019 | Shaw et al. | |
| 2019/0207323 | A1 | 7/2019 | Joung, II et al. | |
| 2019/0252800 | A1 | 8/2019 | Yetisir et al. | |
| 2020/0006846 | A1 | 1/2020 | Lasiter et al. | |
| 2020/0176892 | A1 | 6/2020 | Wang et al. | |

* cited by examiner

BROADBAND ANTENNA SYSTEM

BACKGROUND

Wireless communication devices are increasingly popular and increasingly complex. For example, mobile telecommunication devices have progressed from simple phones, to smart phones with multiple communication capabilities (e.g., multiple cellular communication protocols, Wi-Fi, BLUETOOTH® and other short-range communication protocols), supercomputing processors, cameras, etc. Wireless communication devices have antennas to support communication over a range of frequencies.

It is often desirable to communicate using broad frequency ranges, i.e., bands. These frequency ranges may have one or more sub-bands designated by a corresponding entity, e.g., a standards body or a country. For example, the 5G frequency range from 24.25 GHz to 33.8 GHz includes four sub-bands specified by the 3GPP standards body, three sub-bands specified by the Federal Communications Commission (FCC) of the United States, two sub-bands specified by CEPT (the European Conference of Postal and Telecommunications Administrations), one sub-band specified by China, one sub-band specified by Japan, and one sub-band specified by Korea. As further examples, the 5G frequency range from 37 GHz to 38.2 GHz includes one sub-band specified by the 3GPP standards body, three sub-bands specified by the FCC in the United States, three sub-bands specified by CEPT, and one sub-band specified by China. Different antennas may be used for different sub-bands, or to cover a large sub-band. Due to size and/or cost restraints of many telecommunication devices, it may be desirable to use a single antenna for a wide range of frequencies, e.g., a large sub-band and/or multiple sub-bands.

SUMMARY

An example antenna system includes: a ground conductor comprising an electrically-conductive material; a substrate having a dielectric constant; a pair of dipole conductors disposed such that at least a portion of the substrate is disposed between the ground conductor and the pair of dipole conductors, each of the pair of dipole conductors being a planar conductor; a pair of energy couplers each electrically connected to a respective one of the pair of dipole conductors; and a pair of isolated lobes comprising electrically-conductive material and being electrically separate from the pair of dipole conductors and the pair of energy couplers, each of the pair of isolated lobes being disposed between a respective one of the pair of dipole conductors and the ground conductor, a second portion of a second perimeter of each of the pair of isolated lobes being shaped similarly to a corresponding first portion of a first perimeter of each respective one of the pair of dipole conductors, the second portion of the second perimeter being disposed radially outward of the first portion of the first perimeter.

Implementations of such a system may include one or more of the following features. A flare angle, normal to the first portion of the first perimeter and from a plane of the respective dipole conductor, from the first portion of the first perimeter to the second portion of the second perimeter is between 80° and 89°. The second portion of the second perimeter is disposed between 1 μm and 10 μm outwardly relative to the first portion of the first perimeter. Each respective dipole conductor of the pair of dipole conductors is configured to emit an electric field along the corresponding first portion of the first perimeter, of the respective dipole conductor, at a first angle relative to a first plane of the respective dipole conductor, and wherein each respective isolated lobe is configured and disposed such that the first angle is substantially equal to a second angle from the corresponding first portion of the first perimeter to the second portion of the second perimeter, relative to the first plane, in a second plane transverse to the first plane. The antenna system further includes isolated proximate conductors that are electrically separate from the pair of dipole conductors, the pair of energy couplers, and the pair of isolated lobes, wherein for each member of the pair of dipole conductors and the pair of isolated lobes there is a pair of the isolated proximate conductors laterally displaced from, and disposed on opposite sides of a centerline of, the respective member. In the second plane, each of the pair of isolated proximate conductors are laterally displaced from the respective member by a similar distance. The pair of isolated lobes is a first pair of isolated lobes, the antenna system further including a second pair of isolated lobes each disposed between a respective one of the first pair of isolated lobes and the ground conductor and each having a third portion of a third perimeter shaped similarly to the second portion of the second perimeter of the respective one of the first pair of isolated lobes, and the third portion of the third perimeter is disposed substantially at the second angle relative to the first plane.

Also or alternatively, implementations of such a system may include one or more of the following features. The pair of dipole conductors is disposed in a first layer of the antenna system and the pair of isolated lobes is disposed in a second layer of the antenna system, the antenna system further including an isolated proximate conductor that is electrically separate from the pair of dipole conductors, the pair of energy couplers, and the pair of isolated lobes, and that is disposed in either the first layer of the antenna system or the second layer of the antenna system. The isolated proximate conductor is a first isolated proximate conductor disposed in the first layer of the antenna system, the antenna system further including a second isolated proximate conductor disposed in the second layer of the antenna system. Each dipole conductor of the pair of dipole conductors has a length of about a quarter of a particular wavelength, the first isolated proximate conductor is disposed within a tenth of the particular wavelength of a respective one of the pair of dipole conductors, and the second isolated proximate conductor is disposed within the tenth of the particular wavelength of a respective one of the pair of isolated lobes. A fourth portion of a fourth perimeter of the isolated proximate conductor has a shape similar to at least part of either the corresponding first portion of the first perimeter or the second portion of the second perimeter. The isolated proximate conductor is rectangular.

Also or alternatively, implementations of such a system may include one or more of the following features. The corresponding first portion of the first perimeter is elliptical and the second portion of the second perimeter is elliptical. The pair of energy couplers includes respective portions of respective coaxial transmission lines. The pair of isolated lobes is a first pair of isolated lobes, the antenna system further including a second pair of isolated lobes each disposed between a respective one of the first pair of isolated lobes and the ground conductor, where the second pair of isolated lobes is disposed less than one-twentieth of a particular wavelength closer to the ground conductor than the first pair of isolated lobes. Each dipole conductor of the pair of dipole conductors has a length of about a quarter of the particular wavelength and a width of about a tenth of the particular wavelength.

Also or alternatively, implementations of such a system may include one or more of the following features. The pair of dipole conductors is a first pair of dipole conductors, the pair of energy couplers is a first pair of energy couplers, and the pair of isolated lobes is a first pair of isolated lobes, the antenna system further including: a second pair of dipole conductors disposed orthogonally to the first pair of dipole conductors; a second pair of energy couplers each electrically connected to a respective one of the second pair of dipole conductors; and a second pair of isolated lobes comprising electrically-conductive material and being electrically separate from the second pair of dipole conductors and the second pair of energy couplers, each of the second pair of isolated lobes being disposed between a respective one of the second pair of dipole conductors and the ground conductor. Each dipole conductor of the second pair dipole conductors is shaped similarly to each dipole conductor of the first pair of dipole conductors. The antenna system further includes: a first plurality of isolated proximate conductors that are electrically separate from the first pair of dipole conductors, the first pair of energy couplers, and the first pair of isolated lobes, where for each member of the first pair of dipole conductors and the first pair of isolated lobes there is a pair of the first plurality of isolated proximate conductors laterally displaced from, and disposed on opposite sides of a centerline of, the respective member; and a second plurality of isolated proximate conductors that are electrically separate from the second pair of dipole conductors, the second pair of energy couplers, and the second pair of isolated lobes, where for each member of the second pair of dipole conductors and the second pair of isolated lobes there is a pair of the second plurality of isolated proximate conductors laterally displaced from, and disposed on opposite sides of a centerline of, the respective member. Each of the first plurality of isolated proximate conductors and each of the second plurality of isolated proximate conductors is separate from every other isolated proximate conductor of the first plurality of isolated proximate conductors and every other isolated proximate conductor of the second plurality of isolated proximate conductors.

Another example antenna system includes: a ground conductor comprising an electrically-conductive material; a substrate having a dielectric constant; a pair of dipole conductors disposed such that at least a portion of the substrate is disposed between the ground conductor and the pair of dipole conductors, each of the pair of dipole conductors being a planar conductor; a pair of energy couplers each electrically connected to a respective one of the pair of dipole conductors; and pairs of isolated proximate conductors that are electrically separate from the pair of dipole conductors and the pair of energy couplers, the isolated proximate conductors of each pair of the pairs of isolated proximate conductors being laterally displaced from, and disposed on opposite sides of a centerline of, a respective one of the dipole conductors of the pair of dipole conductors.

Implementations of such a system may include one or more of the following features. Each dipole conductor of the pair of dipole conductors has a length of about a quarter of a particular wavelength, and each isolated proximate conductor of the pairs of isolated proximate conductors is disposed within a tenth of the particular wavelength of a respective one of the dipole conductors of the pair of dipole conductors. An inner edge portion of each of the isolated proximate conductors of each pair of the pairs of isolated proximate conductors has a shape similar to a corresponding adjacent outer edge portion of the respective one of the dipole conductors of the pair of dipole conductors.

DETAILED DESCRIPTION

Techniques are discussed herein for broadband and/or multi-band antenna system operation. For example, an antenna system may include one or more dipoles. Each dipole may comprise a bowtie dipole with two dipole conductors. One or more isolated lobes may be disposed between each of the dipole conductors and a ground conductor. Portions of perimeters of the isolated lobes may be shaped similarly to corresponding portions of perimeters of the dipole conductors. The isolated lobe perimeters may be larger than the corresponding dipole conductor perimeters, with the isolated lobe perimeters disposed to intersect electric field lines that would emanate from the isolated lobe perimeters if the dipole conductors are energized. In addition to, or instead of, the isolated lobes, each of the dipole conductors may have one or more isolated conductors associated with the dipole conductor. The one or more isolated conductors may be laterally displaced from the corresponding dipole conductor and disposed in close proximity to the dipole conductor. If isolated lobes are included in the antenna system, one or more isolated conductors may be associated with each of the isolated lobes. Each isolated conductor may be shaped to have at least a portion of a perimeter of the isolated conductor have a shape similar to a portion of the corresponding dipole conductor or isolated lobe. Other configurations, however, may be used.

Items and/or techniques described herein may provide one or more of the following capabilities, as well as other capabilities not mentioned. For example, antenna systems with small form factors may operate with good characteristics (e.g., return loss (e.g., below 10 dB), gain) over wide bands such as 5G frequency bands including 24.25 GHz to 33.8 GHz and/or 37 GHz to 48.2 GHz. Use of isolated conductors laterally displaced from dipole conductors and/or isolated lobes may help focus an antenna pattern of an antenna system, improving gain. Other capabilities may be provided and not every implementation according to the disclosure must provide any, let alone all, of the capabilities discussed. Further, it may be possible for an effect noted above to be achieved by means other than that noted, and a noted item/technique may not necessarily yield the noted effect.

Figure 1:
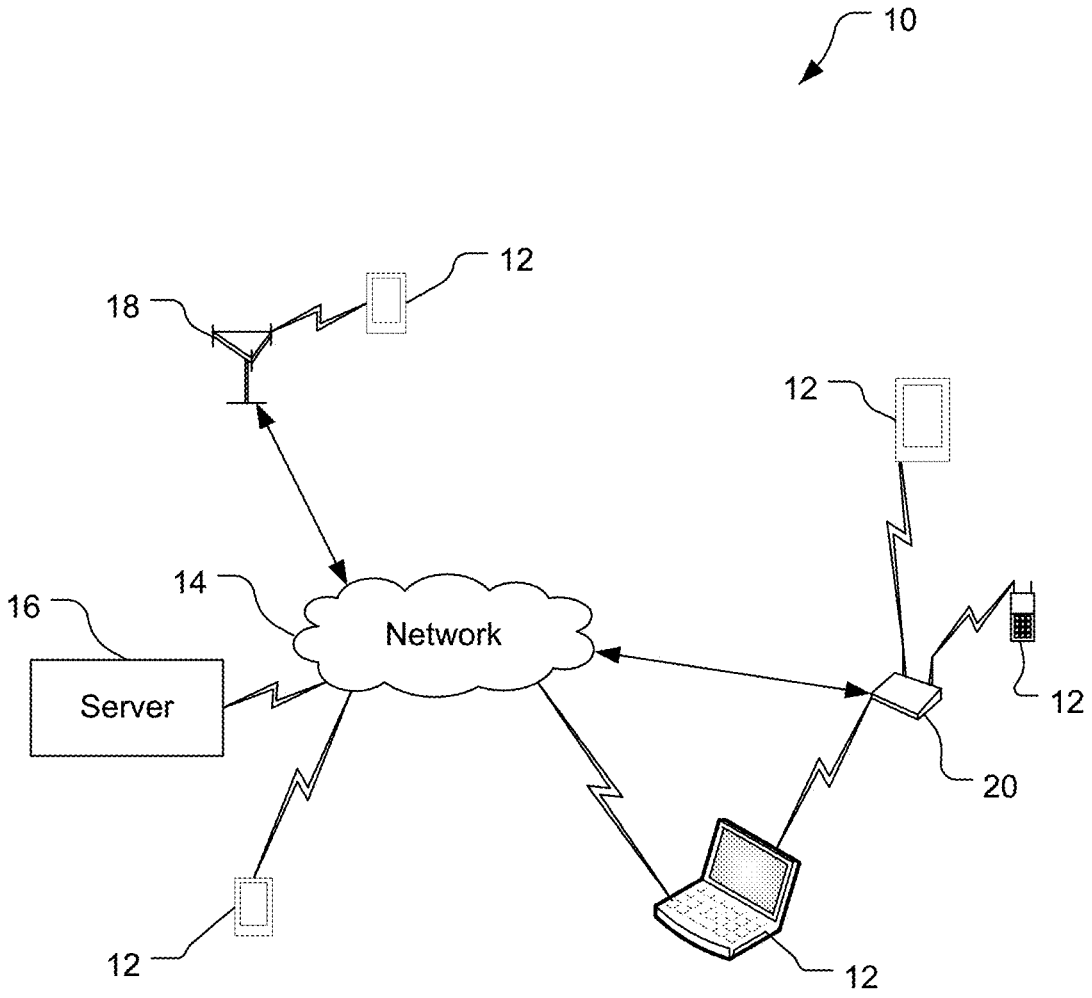
FIG. 1 is a schematic diagram of a communication system.

Referring to FIG. 1, a communication system 10 includes mobile devices 12, a network 14, a server 16, and base stations 18, 20. The system 10 is a wireless communication system in that components of the system 10 can communicate with one another (at least some times using wireless connections) directly or indirectly, e.g., via the network 14 and/or one or more of the access points 18, 20 (and/or one or more other devices not shown, such as one or more base transceiver stations). For indirect communications, the communications may be altered during transmission from one entity to another, e.g., to alter header information of data packets, to change format, etc. The mobile devices 12 shown are mobile wireless communication devices (although they may communicate wirelessly and via wired connections) including mobile phones (including smartphones), a laptop computer, and a tablet computer. Still other mobile devices may be used, whether currently existing or developed in the future. Further, other wireless devices (whether mobile or not) may be implemented within the system 10 and may communicate with each other and/or with the mobile devices 12, the network 14, the server 16, and/or the base stations 18, 20. For example, such other devices may include internet of thing (IoT) devices, medical devices, home entertainment and/or automation devices, etc. The mobile devices 12 or other devices may be configured to communicate in different networks and/or for different purposes (e.g., 5G, Wi-Fi communication, multiple frequencies of Wi-Fi communication, satellite positioning, one or more types of cellular communications (e.g., GSM (Global System for Mobiles), CDMA (Code Division Multiple Access), LTE (Long-Term Evolution), etc.), Bluetooth® communication, etc.). As shown, the base station 18 is a cellular base station and the base station 20 is an access point, but these are examples only and not limiting of the description or claims.

The base stations 18, 20 may each be configured to use (e.g., transmit and/or receive) one or more types of wireless signals in accordance with one or more radio access technologies (RATs). For example, the base stations 18, 20 may be configured to use wireless signals of one or more RATs including GSM (Global System for Mobile Communications), code division multiple access (CDMA), wideband CDMA (WCDMA), Time Division CDMA (TD-CDMA), Time Division Synchronous CDMA (TDS-CDMA), CDMA2000, High Rate Packet Data (HRPD), LTE (Long Term Evolution), and/or 5G NR (5G New Radio). Each of the base stations 18, 20 may be a wireless base transceiver station (BTS), a Node B, an evolved NodeB (eNB), a 5G NodeB (5GNB), etc., and each of the base stations 18, 20 may be referred to as an access point and may be a femtocell, a Home Base Station, a small cell base station, a Home Node B (HNB), a Home eNodeB (HeNB), etc.

The mobile devices 12 may be configured in a variety of ways to use one or more of a variety of wireless signals. For example, each of the mobile devices 12 may be configured to use one or more of the RATs discussed above with respect to the base stations 18, 20. The mobile devices 12 may be any of a variety of types of devices such as a smartphone, a tablet computer, a notebook computer, a laptop computer, etc. Each of the mobile devices 12 may be a User Equipment (UE), a 5G User Equipment (5G UE), a mobile station (MS), a subscriber unit, a target, a station, a device, a wireless device, a terminal, etc.

Figure 2:
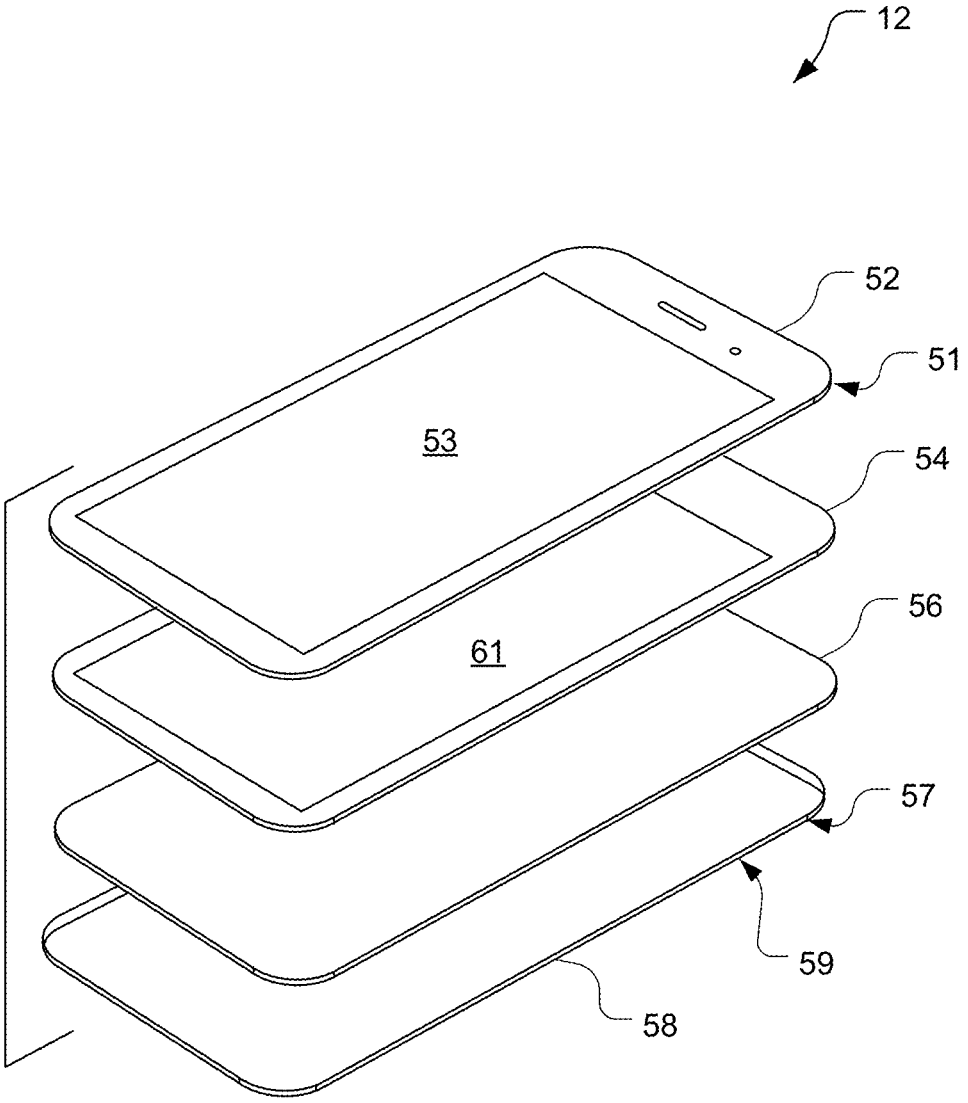
FIG. 2 is an exploded perspective view of simplified components of a mobile device shown in FIG. 1.

Referring to FIG. 2, an example of one of the mobile devices 12 shown in FIG. 1 includes a top cover 52, a display layer 54, a printed circuit board (PCB) layer 56, and a bottom cover 58. The mobile device 12 as shown may be a smartphone or a tablet computer but the discussion is not limited to such devices. The top cover 52 includes a screen 53. The bottom cover 58 has a bottom surface 59 and sides 51, 57 of the top cover 52 and/or the bottom cover 58 may provide an edge surface. The top cover 52 and the bottom cover 58 comprise a housing that retains the display layer 54, the PCB layer 56, and other components of the mobile device 12 that may or may not be on the PCB layer 56. For example, the housing may retain (e.g., hold, contain) antenna systems, front-end circuits, an intermediate-frequency circuit, and a processor discussed below. The housing may be substantially rectangular, having two sets of parallel edges in the illustrated embodiment, and may be configured to bend or fold. In this example, the housing has rounded corners, although the housing may be substantially rectangular with other shapes of corners, e.g., straight-angled (e.g., 45°) corners, 90°, other non-straight corners, etc. Further, the size and/or shape of the PCB layer 56 may not be commensurate with the size and/or shape of either of the top or bottom covers or otherwise with a perimeter of the device. For example, the PCB layer 56 may have a cutout to accept a battery. Those of skill in the art will therefore understand that embodiments of the PCB layer 56 other than those illustrated may be implemented, and that multiple PCB layers may be implemented.

Figure 3:
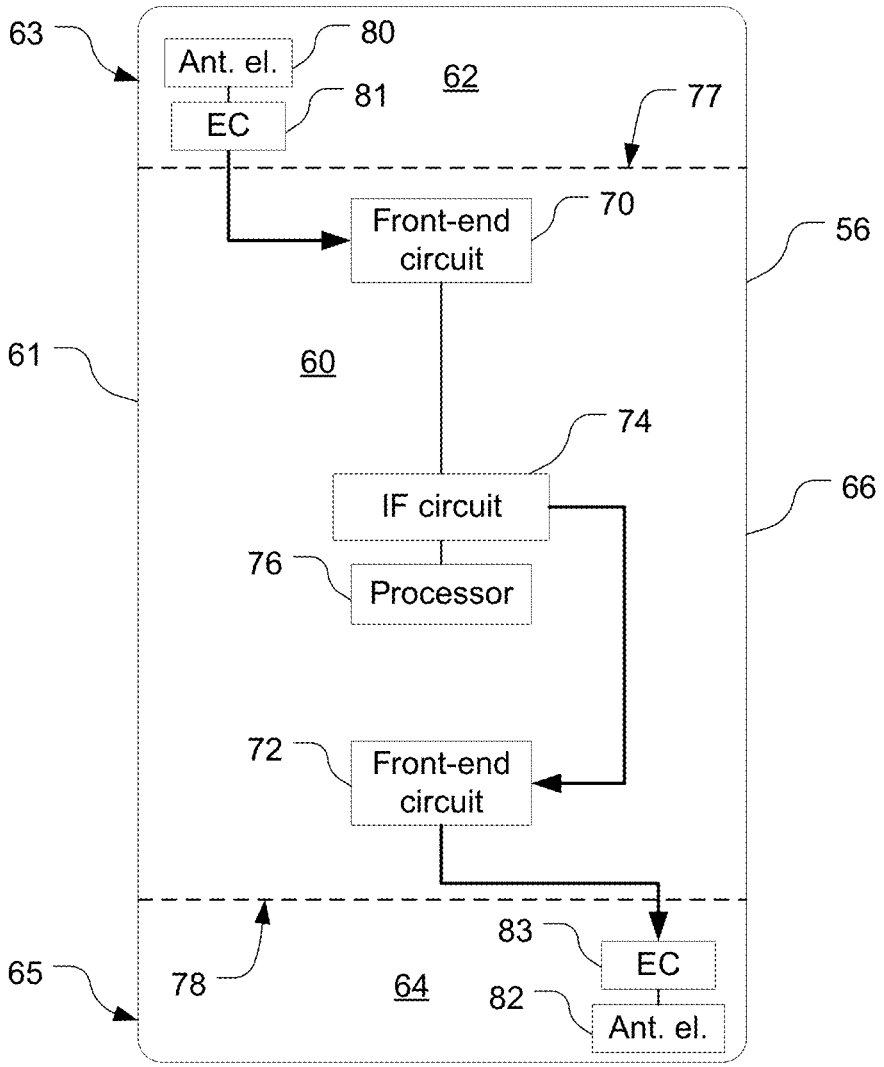
FIG. 3 is a top view of a printed circuit board, shown in FIG. 2, including antennas.

Referring also to FIG. 3, an example of the PCB layer 56 includes a main portion 60 and two antenna systems 62, 64. In the example shown, the antenna systems 62, 64 are disposed at opposite ends 63, 65 of the PCB layer 56, and thus, in this example, of the mobile device 12 (e.g., of the housing of the mobile device 12). The main portion 60 comprises a PCB 66 that includes front-end circuits 70, 72 (also called a radio frequency (RF) circuit), an intermediate-frequency (IF) circuit 74, and a processor 76. The front-end circuits 70, 72 may be configured to provide signals to be radiated to the antenna systems 62, 64 and to receive and process signals that are received by, and provided to the front-end circuits 70, 72 from, the antenna systems 62, 64. The front-end circuits 70, 72 may be configured to convert received IF signals from the IF circuit 74 to RF signals (amplifying with a power amplifier as appropriate), and provide the RF signals to the antenna systems 62, 64 for radiation. The front-end circuits 70, 72 are configured to convert RF signals received by the antenna systems 62, 64 to IF signals (e.g., using a low-noise amplifier and a mixer) and to send the IF signals to the IF circuit 74. The IF circuit 74 is configured to convert IF signals received from the front-end circuits 70, 72 to baseband signals and to provide the baseband signals to the processor 76. The IF circuit 74 is also configured to convert baseband signals provided by the processor 76 to IF signals, and to provide the IF signals to the front-end circuits 70, 72. The processor 76 is communicatively coupled to the IF circuit 74, which is communicatively coupled to the front-end circuits 70, 72, which are communicatively coupled to the antenna systems 62, 64, respectively. In some embodiments, transmission signals may be provided from the IF circuit 74 to the antenna system 62 and/or the antenna system 64 by bypassing the front-end circuit 70 and/or the front-end circuit 72, for example when further upconversion is not required by the front-end circuit 70 and/or the front-end circuit 72. Signals may also be received from the antenna system 62 and/or the antenna system 64 by bypassing the front-end circuit 70 and/or the front-end circuit 72. In other embodiments, a transceiver separate from the IF circuit 74 is configured to provide transmission signals to and/or receive signals from the antenna system 62 and/or the antenna system 64 without such signals passing through the front-end circuit 70 and/or the front-end circuit 72. In some embodiments, the front-end circuits 70, 72 are configured to amplify, filter, and/or route signals from the IF circuit 74 without upconversion to the antenna systems 62, 64. Similarly, the front-end circuits 70, 72 may be configured to amplify, filter, and/or route signals from the antenna systems 62, 64 without downconversion to the IF circuit 74.

In FIG. 3, the dashed lines separating the antenna systems 62, 64 from the PCB 66 indicate functional separation of the antenna systems 62, 64 (and the components thereof) from other portions of the PCB layer 56. Portions of the antenna systems 62, 64 may be integral with the PCB 66, being formed as integral components of the PCB 66. One or more components of the antenna system 62 and/or the antenna system 64 may be formed integrally with the PCB 66, and one or more other components may be formed separate from the PCB 66 and mounted to the PCB 66, or otherwise made part of the PCB layer 56. Alternatively, each of the antenna systems 62, 64 may be formed separately from the PCB 66 and mounted to the PCB 66 and coupled to the front-end circuits 70, 72, respectively. In some examples, one or more components of the antenna system 62 may be integrated with the front-end circuit 70, e.g., in a single module or on a single circuit board. For example, the front-end circuit 70 may be physically attached to the antenna system 62, e.g., attached to a back side of a ground conductor (ground plane) of the antenna system 62. Also or alternatively, one or more components of the antenna system 64 may be integrated with one or more components of the front-end circuit 72, e.g., in a single module or on a single circuit board. For example, an antenna of the antenna system 62 may have front-end circuitry electrically (conductively) coupled and physically attached to the antenna while another antenna may have the front-end circuitry physically separate, but electrically coupled to the other antenna. The antenna systems 62, 64 may be configured similarly to each other or differently from each other. For example, one or more components of either of the antenna systems 62, 64, may be omitted. As an example, the antenna system 62 may include 4G and 5G radiators while the antenna system 64 may not include (may omit) a 5G radiator. In other examples, an entire one of the antenna systems 62, 64 may be omitted. While the antenna systems 62, 64 are illustrated as being disposed at the top and bottom of the mobile device 12, other locations of the antenna system 62 and/or the antenna system 64 may be implemented. For example, one or more antenna systems may be disposed on a side of the mobile device 12. Further, more antenna systems than the two antenna systems 62, 64 may be implemented in the mobile device 12.

A display 61 (see FIG. 2) of the display layer 54 may roughly cover the same area as the PCB 66, or may extend over a significantly larger area (or at least over different regions) than the PCB 66, and may serve as a system ground conductor for at least portions, e.g., feed lines, of the antenna systems 62, 64 (and possibly other components of the device 12) although the PCB 66 may also provide a ground conductor for components of the system. The display 61 may be coupled to the PCB 66 to help the PCB 66 serve as a ground conductor. The display 61 is disposed below the antenna system 62 and above the antenna system 64 (with "above" and "below" being relative to the mobile device 12, i.e., with a top of the mobile device 12 being above other components regardless of an orientation of the device 12 relative to the Earth). In some embodiments, the antenna systems 62, 64 may have widths approximately equal to a width of the display 61. The antenna systems 62, 64 may extend less than about 10 mm (e.g., 8 mm) from edges, here ends 77, 78, of the display 61 (shown in FIG. 3 as coinciding with ends of the PCB 66 for convenience, although ends of the PCB 66 and the display 61 may not coincide). This may provide sufficient electrical characteristics for communication using the antenna systems 62, 64 without occupying a large area within the device 12.

The antenna system 62 includes one or more antenna elements 80 and one or more corresponding energy couplers 81, and the antenna system 64 includes one or more antenna elements 82 and one or more corresponding energy couplers 83. The antenna elements 80, 82 are transducer elements as they are configured to transduce wireless electromagnetic energy (signals) to wired electric or electromagnetic energy and vice versa. The antenna elements 80, 82 may be referred to as "radiators" although the antenna elements 80, 82 may radiate energy and/or receive energy. The energy couplers 81, 83 may be referred to as "feeds," but an energy coupler may convey energy to a radiator from a front-end circuit, or may convey energy from a radiator to the front-end circuit. An energy coupler may be conductively connected to a radiator or may be physically separate from the radiator and configured to capacitively or inductively couple energy to or from the radiator. For example, an energy coupler may include an electrically-conductive line that is physically and electrically connected to the corresponding antenna element (e.g., radiator). For example, the energy coupler may be a conductive line (e.g., conductive vias connected to each other), a coaxial line, etc.

Example Antenna System—Dipole with Stacked and Laterally-Displaced Conductors

Figure 4:
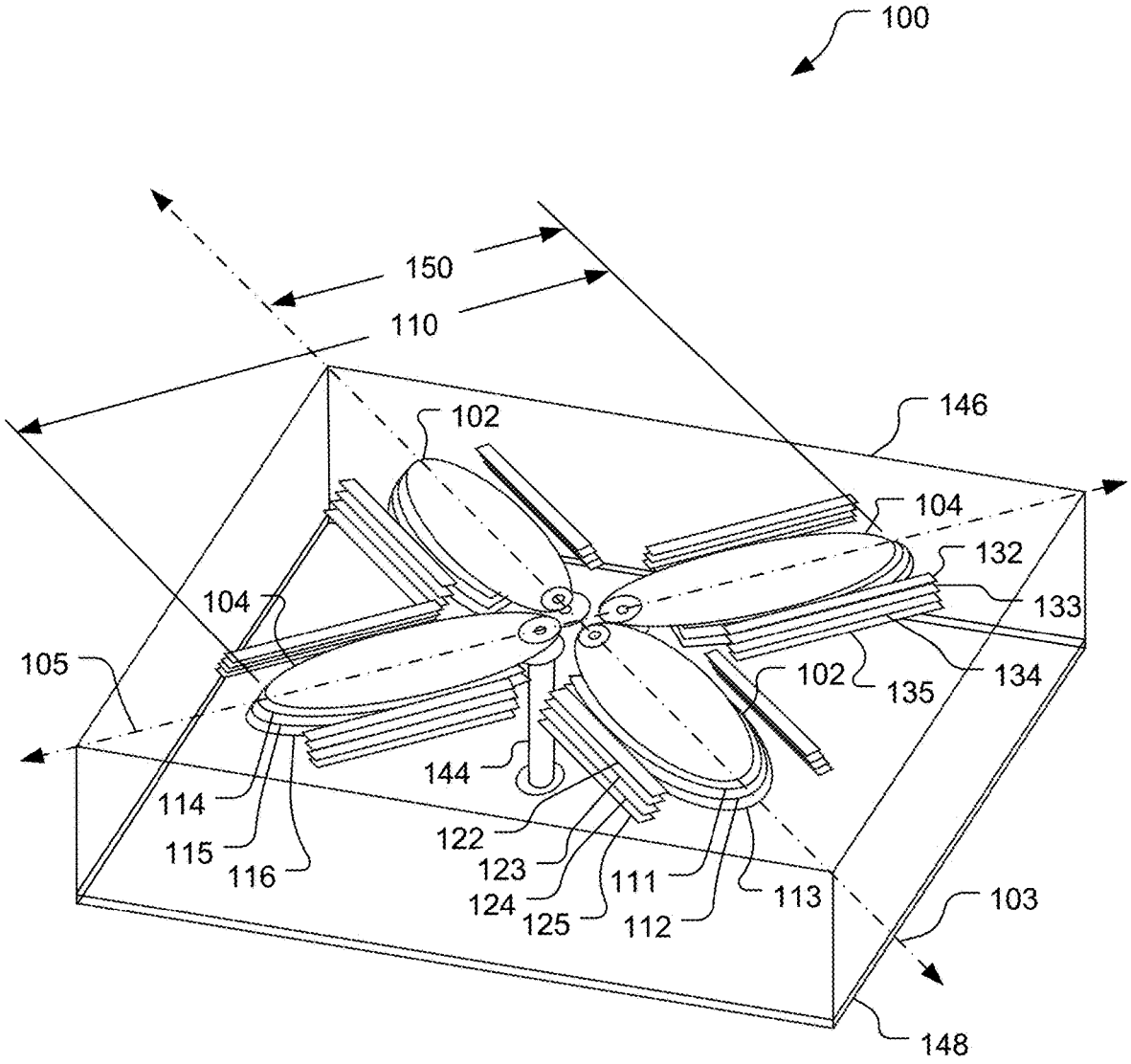
FIG. 4 is a perspective view of an example of an antenna system shown in FIG. 3.

Referring to FIG. 4, with further reference to FIG. 3, an antenna system 100 is an example of the antenna system 62 (or the antenna system 64). The antenna system 100 is a stacked-dipole antenna system including dipole conductors 102, 104, isolated lobes 111, 112, 113, 114, 115, 116, isolated conductors 122, 123, 124, 125, 132, 133, 134, 135, energy couplers 142, 144 (see FIGS. 5-7 for the energy coupler 142), a substrate 146, and a ground conductor 148. The antenna system 100 may be configured to operate over a broad frequency range including multiple sub-bands. For example, the antenna system 100 may operate over a range of 24.25 GHz to 33.8 GHz with return loss ($S_{11}$) for radiation (even if the system is not used for radiation) that may be below a threshold level, e.g., −5 dB, or −10 dB, or −15 dB (or other value) over the entire band. Each of the isolated lobes 111-116 and each of the isolated conductors 122-125, 132-135 comprises electrically-conductive material (e.g., metal such as copper) and is isolated from (not electrically connected to, i.e., unconnected from, electrically separate from) the dipole conductors 102, 104, or the energy couplers 142, 144, or even any other conductive material of the antenna system 100. The isolated lobes 111-116 and the isolated conductors 122-125, 132-135 are not directly connected to a power source (e.g., by not being directly connected to the energy couplers 142, 144). Any of the isolated lobes 111-116 or the isolated conductors 122-125, 132-135 may be referred to as a parasitic element. Providing parasitic elements in conjunction with the dipole conductors 102, 104 may improve bandwidth of the antenna system 100. For example, the isolated lobes 111-116 may reflect energy from the dipole conductors 102, 104 and the isolated conductors 122-125, 132-135 may help improve directionality (e.g., narrow a beamwidth) and/or improve gain of an antenna pattern of the antenna system 100. While three isolated lobes 111-113, 114-116 correspond to each of the dipole conductors 102, 104, respectively, other quantities of isolated lobes (e.g., one per dipole conductor, or two per dipole conductor, or four or more per dipole conductor) may be used.

The energy couplers 142, 144 are physically connected to respective ones of the dipole conductors 102, 104 to couple energy to and/or from the dipole conductors 102, 104. Other techniques may be used to couple energy to and/or from the dipole conductors 102, 104. For example, the dipole conductors 102, 104 could be aperture fed (capacitively fed), which may be less expensive than using the energy couplers 142, 144 but may reduce one or more performance characteristics such as gain and/or bandwidth.

The dipole conductors 102, 104 are electrically conductive and sized, shaped, and disposed for operation over a desired frequency band. For example, the dipole conductors 102 are a pair of conductors forming one dipole and the dipole conductors 104 are another pair of conductors forming another dipole. The dipole conductors 102 share a common centerline 103 and the dipole conductors 104 share a common centerline 105. In this example, with further reference to FIG. 5, the dipole conductors 102, 104 each have an approximately elliptical shape (e.g., with a length 106 of a major axis 107 of the dipole conductor 102, given a length 108 of a minor axis 109 of the dipole conductor 102, being within 10% of a length of the major axis 107 for an ellipse, or with a combined distance from two foci to any point on a perimeter of the dipole conductor 102 being within 10% of every other such distance). The length 108 (which is a width of the dipole conductor 102) may be varied to alter performance characteristics (e.g., return loss and/or gain) of the antenna system 100. The length 106 of each of the dipole conductors 102 may be about (e.g., slightly less than) one-quarter of a wavelength in the substrate 146 at a desired frequency, e.g., at or near the middle of the desired frequency band, such that a distance 150 from a center of the dipole to an end of the dipole is about one-quarter (e.g., 22%-28%) of a wavelength in the substrate 146 at the desired frequency. The length 108 (i.e., the dipole conductor width) may, for example, be about one-tenth (e.g., 9%-11%) of the wavelength in the substrate 146 at the desired frequency. The dipole conductors 102 are sized and disposed relative to each other such that an end-to-end distance 110 of the dipole conductors 102 is about one-half (e.g., 45%-55%) of the wavelength in the substrate 146 at the desired frequency. The dipole conductors 102, 104 are disposed such that bottom surfaces (i.e., surfaces nearer the ground conductor 148) are disposed a distance 176 (see FIG. 6) from the ground conductor 148 of about one-quarter of the wavelength (e.g., 22%-28%) in the substrate 146 at the desired frequency.

The shapes and configurations shown of the dipole conductors 102, 104 are examples. Due to the shapes of the dipole conductors 102, 104, the antenna system 100 may be referred to as a bowtie antenna. Other shapes, e.g., non-elliptical, may be used for the dipole conductors 102, 104. The dipole conductors 102 are shaped similarly to each other and to the dipole conductors 104. In the antenna system 100 example as shown, there are two pairs of transducer elements, here the dipole conductors 102, 104 forming two dipoles. Other configurations may be used, for example with only one pair of dipole conductors forming one dipole, or with other transducer element configurations other than dipoles (e.g., monopoles, patch radiators, etc.). As another example, the dipole conductors 102 may be shaped and/or sized differently than the dipole conductors 104. In any of such alternative configurations, parasitic elements may be included similar to the discussion herein. For example, isolated lobes may be provided that flare in size relative to the transducer elements, e.g., with each isolated lobe parasitic element between the respective transducer element and the ground conductor 148 having a larger perimeter than (and overlapping substantially all of) the isolated lobe immediately further from the ground conductor 148. The isolated lobes may have at least portions of their perimeters shaped similarly to the respective transducer element. Isolated conductors (e.g., akin to the isolated conductors 122-125, 132-135) may also or alternatively be provided adjacent to the transducer elements and/or adjacent to the isolated lobes. Each of the isolated conductors may be displaced similarly from the respected isolated lobe or transducer elements such that the isolated conductors disposed adjacent the same isolated lobe are disposed further from each other than the isolated conductors disposed adjacent to an isolated lobe disposed further from the ground conductor 148, or disposed adjacent to the transducer element.

The dipole conductors 102, 104, the isolated lobes 111-116, the isolated conductors 122-125, 132-135, and the ground conductor 148 may all be substantially planar. For example, major surfaces (that comprise a majority of surface area of a conductor, such as a surface 156 of the dipole conductor 102) extending the lengths and widths of the respective items may be substantially planar, e.g., with the surfaces deviating less than 10% of their respective lengths from being completely flat. The antenna system 100 may be a multi-layered system with the system 100 being formed in layers with the dipole conductors 102, 104, the isolated lobes 111-116, the isolated conductors 122-125, 132-135, and the ground conductor 148 disposed in various layers of the system 100.

Figure 6:
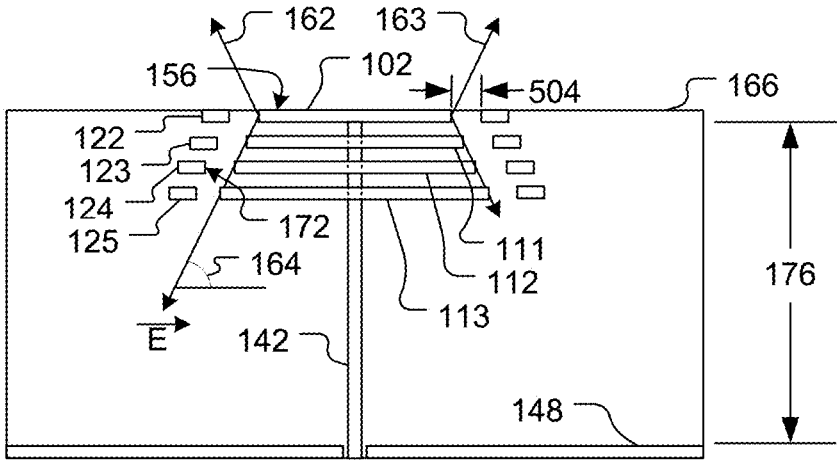
FIG. 6 is a side view of a portion of the antenna system shown in FIG. 4, being an end view of a dipole conductor, and including the dipole conductor, a corresponding energy coupler, corresponding isolated lobes and isolated conductors, a substrate, and a ground conductor.
Figure 7:
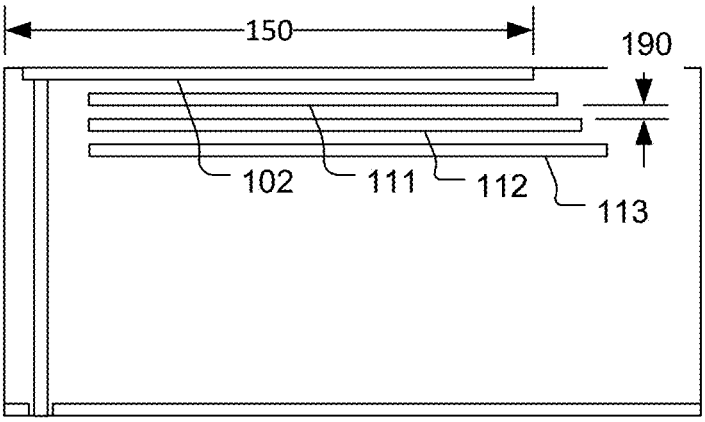
FIG. 7 is a side view of a portion of the antenna system shown in FIG. 4, being a side view of the dipole conductor, and including the dipole conductor, a corresponding energy coupler, corresponding isolated lobes, the substrate, and the ground conductor.

Referring also to FIGS. 6-7, the isolated lobes 111-116 in this example are shaped similarly to the dipole conductors 102, 104 but are larger than the dipole conductors 102, 104. The isolated lobes 111-116 are also truncated relative to the dipole conductors 102, 104, with the isolated lobes 111-116 each being separated from the respective energy coupler 142, 144, here being truncated in edges that are each separated from the respective energy coupler 142, 144, e.g., edges 151, 152, 153 of the isolated lobes 111, 112, 113 being separated from the energy coupler 142 (e.g., separated by at least a minimum line width manufacturing constraint such as 50 microns or 75 microns). The edges 151, 152, 153 in this example are flat, being parallel to the minor axis 109, but other shapes of the edges 151, 152, 153 may be used. For example, the edges 151, 152, 153 could be concave arcs, e.g., with a uniform radius such that the edges 151, 152, 153 are circular arcs. Substantial portions (e.g., greater than 20% such as 70% or more of perimeters in the example shown) of the isolated lobes 111-116 are shaped similarly to corresponding substantial portions of the dipole conductors 102, 104.

The isolated lobes 111-116 are aligned with the dipole conductors 102, 104, respectively. The isolated lobes 111-116 are aligned with the dipole conductors 102, 104 in that major axes of the isolated lobes and the major axis of the corresponding dipole conductor 102, 104 lie in a single plane, and minor axes of the isolated lobes and the minor axis of the corresponding dipole conductor 102, 104 lie in a single plane. The isolated lobes 111-116 are disposed between the dipole conductors 102, 104 and the ground conductor 148. The isolated lobes 111, 112, 113 and the isolated lobes 114, 115, 116 are separated from each other by a separation distance that may affect performance characteristics of the antenna system 100. For example, the isolated lobes 111, 112, 113 may be spaced apart from each other by a distance 190 of about 60 μm (i.e., nearest surfaces of the lobes 111, 112, 113 being displaced by the distance 190) in the substrate 146. In some embodiments, the substrate 146 has a dielectric constant between 3.0 and 3.5. The substrate 146 may comprise multiple materials with multiple, different dielectric constants such that the dielectric constant of the substrate 146 is a composite dielectric constant due to the combination of materials. As another example, the distance 190 may be about one-twentieth, or less, of a wavelength in the substrate 146 at a desired frequency, e.g., less than 6% of the wavelength, such that each isolated lobe is disposed less than about one-twentieth of the wavelength closer to the ground conductor 148 than the next nearest isolated lobe or dipole conductor.

The isolated lobes 111-116 are sized and disposed such that if the dipole conductors 102, 104 are energized, electric field lines emitted from edges of the dipole conductors 102, 104 would intersect edges of the isolated lobes 111-116. The dipole conductors 102, 104 are configured such that if the dipole conductors 102, 104 are energized (e.g., receive energy from the energy couplers 142, 144 of appropriate frequency), then the dipole conductors 102, 104 will emit electric fields along substantial portions of their perimeters, if not along their entire perimeters. The isolated lobes 111-116 are sized, shaped, and disposed such that substantial portions, e.g., the curved portions shaped similarly to the dipole conductors 102, 104, of the isolated lobes 111-116 will intersect the electric field emitted along the substantial portions of the perimeters of corresponding ones of the dipole conductors 102, 104. The isolated lobes 111-116 are sized and disposed such that the isolated lobes 111-116 flare with respect to the dipole conductors 102, 104 in a direction from the dipole conductors 102, 104 toward the ground conductor 148. That is, perimeters of the isolated lobes 111-116 flare outward relative to respective perimeters of the dipole conductors 102, 104 from the dipole conductors 102, 104 toward the ground conductor 148. Thus, the isolated lobes 111, 114 flare outward relative to the dipole conductors 102, 104, the isolated lobes 112, 115 flare outward relative to the isolated lobes 111, 114, and the isolated lobes 113, 116 flare outward relative to the isolated lobes 112, 115. Perimeters of the isolated lobes 111 are disposed radially outward relative to perimeters of the dipole conductors 102 (i.e., away from an interior of the dipole conductors 102). The isolated lobes 111, 114 may be larger, e.g., 2%-10% (for example, 3%-5% in some embodiments, with certain such embodiments being approximately 4%) larger, in area than corresponding portions of the dipole conductors 102, 104 (i.e., portions of the dipole conductors 102, 104 overlapped by the isolated lobes 111, 114, i.e., further from the energy couplers 142, 144 than the edges 151-153 are from the energy coupler 142). The isolated lobes 112, 115 may be larger, e.g., 2%-10% (for example, 3%-5% in some embodiments, with certain such embodiments being approximately 4%) larger, in area than the isolated lobes 111, 114, and the isolated lobes 113, 116 may be larger, e.g., 2%-10% (for example, 3%-5% in some embodiments, with certain such embodiments being approximately 4%) larger, in area than the isolated lobes 112, 115. That is, each of the isolated lobes may be larger in area than the corresponding portion of the aligned conductive element that is the next-furthest conductive element from the ground conductor 148.

As shown in FIG. 6, electric field lines 162, 163 corresponding to the electric field that would be produced and emitted from edges on the perimeter of the dipole conductor 102 in a plane normal (transverse) to the perimeter of the dipole conductor 102, here a plane including the minor axis of the dipole conductor 102, intersect the edges of the perimeters of the isolated lobes 111, 112, 113. An angle 164 of the electric field line 162 relative to a plane 166 of the dipole conductor 102 is substantially equal to (e.g., within +/−10%) a flare angle, in a plane normal to the perimeter of the dipole conductor 102, from the perimeter of the dipole conductor 102 to the perimeter of the isolated lobe 111, from the perimeter of the dipole conductor 102 to the perimeter of the isolated lobe 112, and from the perimeter of the dipole conductor 102 to the perimeter of the isolated lobe 113 relative to the plane 166. That is, at any given point over the portion of an isolated lobe 111-116 shaped similarly to a corresponding dipole conductor 102, 104, the angle 164 is substantially equal to the flare angle which is the angle from the perimeter of the dipole conductor 102, 104 to the given point on the isolated lobe 111-116 relative to a plane of the dipole conductor 102, 104 and in a plane normal to a tangent to the perimeter of the isolated lobe 111-116 at the given point. Thus, perimeters of substantial portions, e.g., the curved portions (i.e., the portions other than the edges 151, 152, 153) of the isolated lobes 111, 112, 113 are disposed along the electric field lines emitted from corresponding substantial portions of the perimeters of the dipole conductors 102 if energized (and similarly for the isolated lobes 114, 115, 116 and the dipole conductors 104). The angle 164 may be referred to as the flare angle as the angle 164 and the flare angle are substantially equal. The value of the flare angle may depend on a frequency range over which the antenna system 100 is designed to operate, with lengths and widths of the dipole conductors 102, 104, the isolated lobes 111-116, and the isolated conductors 122-125, 132-135 being dependent on this frequency range as well. The flare angle 164 may be less than 90°. For example, the flare angle may be about 89° or less (e.g., 80°-89° or 85°-89°) with each isolated lobe extending between about 1 μm and 11 μm further outwardly than the immediately-above lobe (next-further lobe from the ground conductor 148) and being separated from the immediately-above lobe by about 60 μm. Other values of the flare angle 164 may be used, e.g., 80°-87°, 85°-87°).

As described above, each of the isolated lobes 111-116 may be progressively larger the closer the isolated lobe 111-116 is to the ground conductor 148, i.e., the further the isolated lobe is from the respective dipole conductor 102, 104. For example, portions of the isolated lobes 111-116 may have similarly-shaped perimeters to corresponding portions of the dipole conductors 102, 104, but with perimeters that are expanded normally to the perimeters of the dipole conductors 102, 104. In some embodiments, points on the expanded perimeters and the perimeters of the dipole conductors 102, 104 are disposed along lines coinciding with electric field lines of electric fields that would emanate from the dipole conductors 102, 104.

Figure 8:
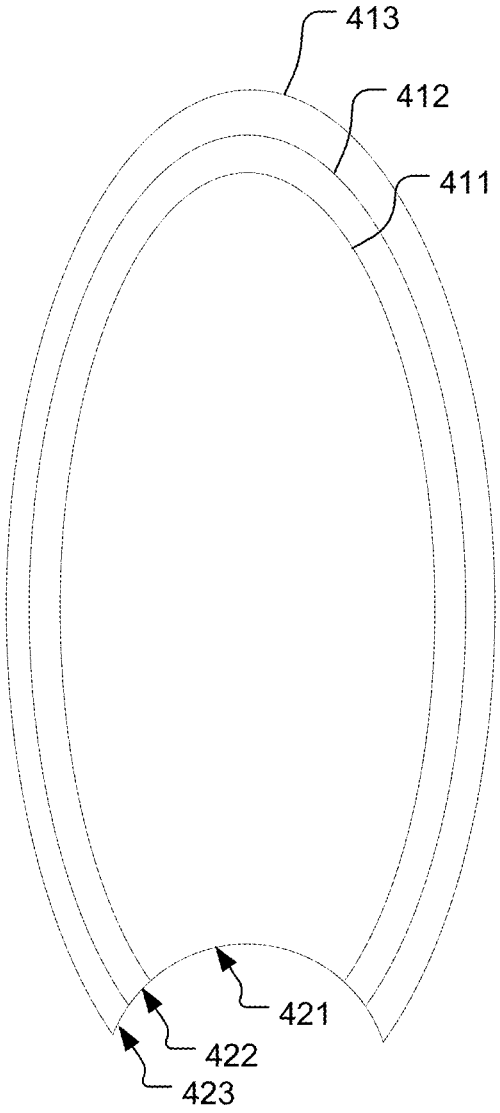
FIG. 8 is a top view of alternatively-configured isolated lobes.

Other configurations of isolated lobes may be used. For example, referring also to FIG. 8, instead of the isolated lobes 111-116 with flat ends, isolated lobes 411, 412, 413 may be used that have partially-elliptical shapes similar to the isolated lobes 111-116, but with non-flat truncated ends, e.g., curved truncated ends, in this example concave arcuate ends 421, 422, 423, instead of the flat ends of the isolated lobes 111-116. Still other configurations of isolated lobes may be used.

The isolated conductors 122-125, 132-135 may be provided in pairs each corresponding to a respective one of the dipole conductors 102, 104 or a respective one of the isolated lobes 111-116. For each dipole conductor 102, 104 and each isolated lobe 111-116, there is a pair of the isolated conductors 122-125, 132-135 laterally displaced from, and disposed on opposite sides of a centerline 103, 105 of, the respective member (i.e., the respective dipole conductor 102, 104 or the respective isolated lobe 111-116). The isolated conductors 122-125, 132-135 may be disposed proximately to the corresponding dipole conductors 102, 104 and the corresponding isolated lobes 111-116 and may be called isolated proximate conductors. For example, the isolated conductors 122-125, 132-135 may have a minimum separation of about one-tenth (e.g., 9%-11%) of a wavelength at a desired frequency in the substrate 146 from the respective dipole conductor 102, 104 or the respective isolated lobe 111-116.

Figure 5:
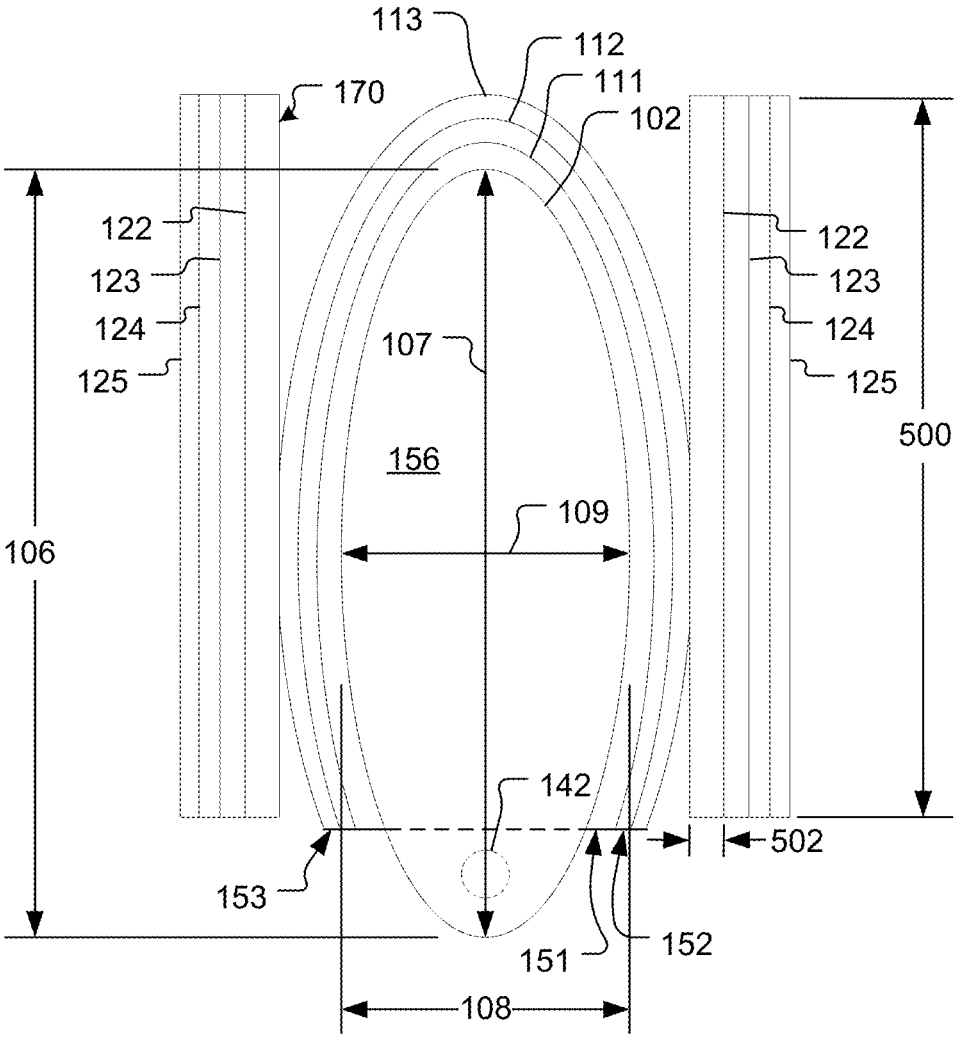
FIG. 5 is a top view of a dipole conductor and corresponding isolated lobes and isolated conductors of the antenna system shown in FIG. 4.

The isolated conductors 122-125, 132-135 may be disposed to flare outwardly with proximity to the ground conductor 148. The isolated conductors 122-125, 132-135 are disposed such that each of the isolated conductors 122-125, 132-135 that is nearer to the ground conductor 148 has an inner edge (an inner portion of a perimeter of the isolated conductors 122-125, 132-135) that is displaced laterally (e.g., parallel to the ground conductor 148 and parallel to the plane 166) further from the centerline 103, 105 of the corresponding dipole conductor 102, 104. The isolated conductors 122-125, 132-135 being laterally displaced from the dipole conductors 102, 104 are in the same plane(s) as the respective dipole conductors 102, 104, e.g., in the same layer of the structure of the antenna system 100. Thus, an inner edge 170 (see FIG. 5) of the isolated conductor 122 is closer to the centerline 103 (see FIG. 4), that is colinear with the major axis 107, than an inner edge 172 (see FIG. 6) of the isolated conductor 124. The inner edge 170 (or other inner edge of an isolated conductor) may be closer to the centerline 103 than one or more perimeters of one or more of the isolated lobes 111-113. That is, one or more of the isolated conductors 122-125 may overlap with one or more of the isolated lobes 111-113. For example, as shown in FIGS. 5 and 6, portions of the isolated conductors 122 overlap with portions of the isolated lobe 113. In other embodiments, the inner edge 170 is spaced further from the centerline 103 than an outermost edge of the largest isolated lobe (e.g., the isolated lobe 113), for example such that none of the isolated conductors 122-125 overlap with any of the isolated lobes 111-113 when viewed as depicted in FIG. 6. The isolated conductors 122-125, 132-135 may each be separated from the respective dipole conductor 102, 104 or isolated lobe 111-116 by the same amount such that the flaring of the dipole conductors 102, 104 and the isolated lobes 111-116 results in flaring of the isolated conductors 122-125, 132-135. The amount of separation between the isolated conductors 122-125, 132-135 and the respective dipole conductors 102, 104 and isolated lobes 111-116 may affect one or more performance characteristics (e.g., bandwidth, return loss, gain) and may be selected to provide one or more desired performance characteristic values. The amount of separation may be as low as a lowest separation possible given manufacturing constraints of the antenna system 100 (e.g., a minimum line width for a semiconductor fabrication). The isolated conductors 122-125, 132-135 may flare at about the same flare angle 164 as the dipole conductors 102, 104 and the isolated lobes 111-116. For example, each of the isolated conductors 122-125, 132-135 may be displaced from the respective dipole conductor 102, 104 or the respective isolated lobe 111-116 similarly, e.g., laterally displaced (separated) by a similar distance (e.g., a smallest displacement distance for each isolated conductor 122-125, 132-135 of X+/−10%) and with the same orientation.

Figure 9:
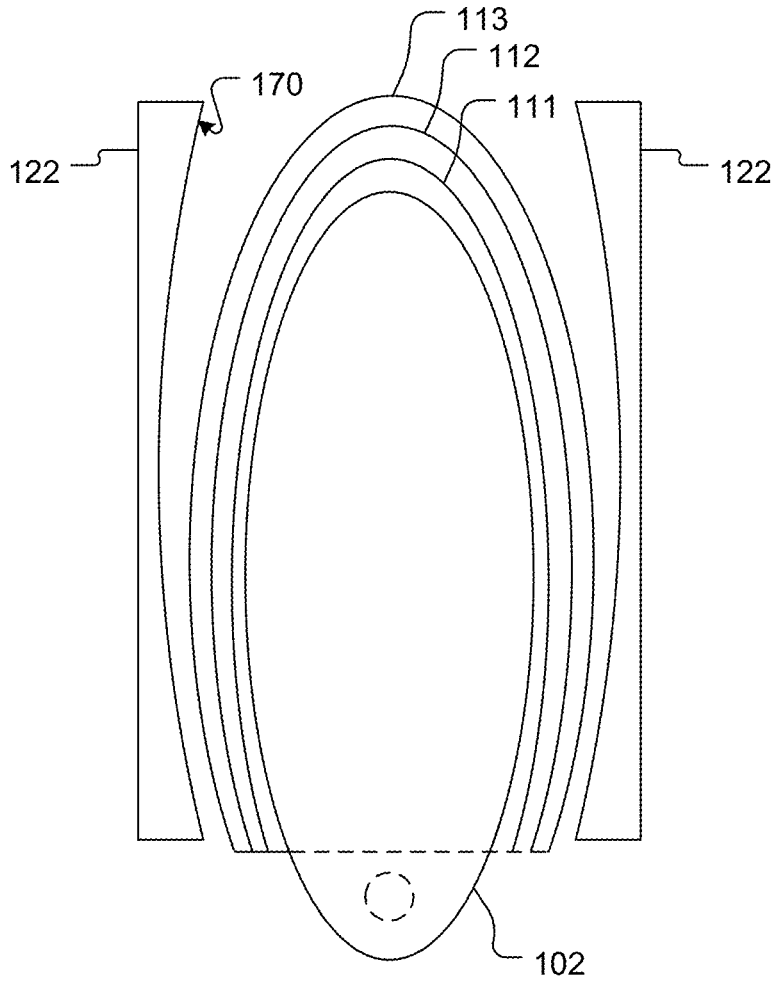
FIG. 9 is a top view of a dipole conductor and corresponding isolated lobes, and an alternative configuration of isolated conductors of the antenna system shown in FIG. 4.

In the example shown, the isolated conductors 122-125, 132-135 are rectangles (i.e., rectangularly shaped), all with the same shape and size. Other shapes for the isolated conductors 122-125, 132-135, however, may be used. For example, as shown in FIG. 9 with only the isolated conductors 122 shown for simplicity, a portion of the perimeter of each of the isolated conductors 122-125, 132-135 may be shaped similarly to an adjacent portion of the perimeter of the corresponding dipole conductor 102, 104 or the corresponding isolated lobe 111-116. The portion of each isolated conductor adjacent to a dipole conductor or isolated lobe may be shaped the same, or may be different, e.g., to be similar to a corresponding portion of the corresponding dipole conductor or isolated lobe (e.g., the dipole conductor or isolated lobe laterally closest to the isolated conductor in the same layer as the isolated conductor). As shown, the inner edge 170 of the isolated conductors 122 in this example are concave, e.g., elliptical. The shapes of the outer edges of the isolated conductors may be different from the shapes of the inner edges of the isolated conductors, here being elliptical and straight, respectively.

Figure 10:
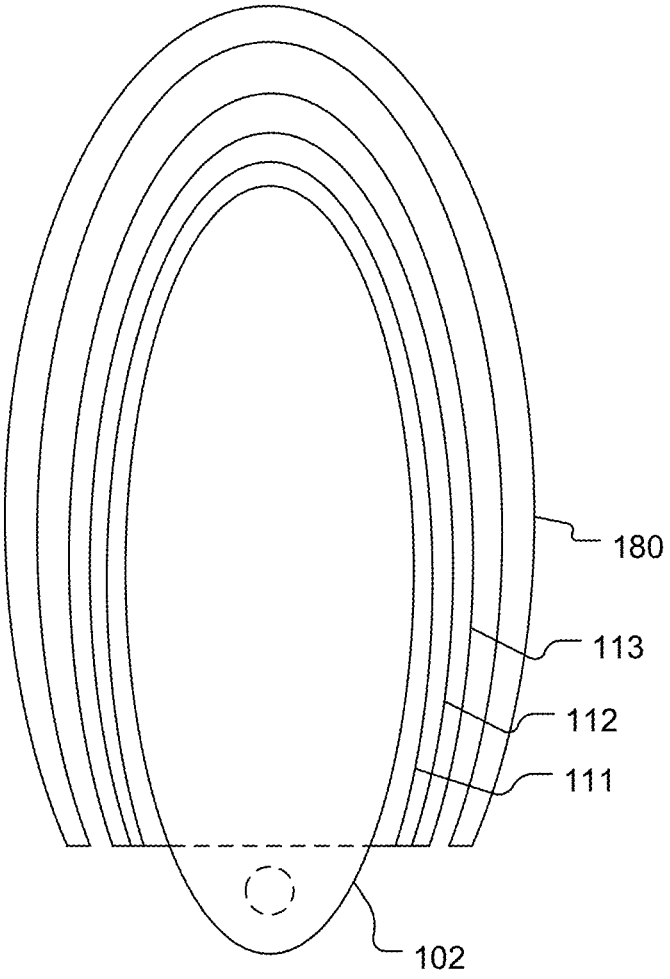
FIG. 10 is a top view of a dipole conductor and corresponding isolated lobes, and an alternative configuration of an isolated conductor of the antenna system shown in FIG. 4.

The isolated conductors 122-125, 132-135 are shown having the same shapes and lengths and terminating approximately even with ends of the largest isolated lobes, here the isolated lobes 113, 116. This is an example only. The isolated conductors 122-125, 132-135 may have different shapes and/or lengths, although pairs of the isolated conductors 122-125, 132-135 bordering the same dipole conductor or isolated lobe will typically have the same shape and length and be disposed symmetrically about the respective dipole conductor or isolated lobe. The isolated conductors 122-125, 132-135 may have different lengths such that they terminate approximately even with the corresponding dipole conductor 102, 104 or isolated lobe 111-116 (e.g., the dipole conductor or isolated lobe adjacent to (nearest to) and in the same layer as the isolated conductor). As another example, the isolated conductors 122-125, 132-135 may terminate beyond an end of the corresponding dipole conductor or isolated lobe, or even beyond the end of the largest isolated lobe. As yet another example, instead of a dipole conductor or isolated lobe having a pair of corresponding isolated conductors, one or more of the dipole conductors or isolated lobes may have a single corresponding isolated conductor that extends around the end of the dipole conductor or isolated lobe. An example of this is shown in FIG. 10 for the dipole conductor 102 and an isolated conductor 180. As yet another example, not every one of the dipole conductors 102, 104 and/or not every one of the isolated lobes 111-116 may have a corresponding isolated conductor. Thus, for example, the antenna system 100 may have an isolated conductor disposed in one layer of the antenna system 100 but no isolated conductor disposed in another layer of the antenna system 100. As another example, each dipole conductor 102, 104 may have one or more corresponding isolated conductors while one or more of the isolated lobes 111-116 do not. As yet another example, one or more of the isolated lobes 111-116 may have one or more corresponding isolated conductors while the dipole conductors 102, 104 do not.

The isolated conductors 122-125, 132-135 may have any of various widths. For example, the isolated conductors 122-125, 132-135 may have a width at least as large as threshold width due to manufacturing constraints. For example, the isolated conductors 122-125, 132-135 may be at least 50 microns in width (e.g., at their thinnest part if the width is not uniform). The widths and/or shapes of the isolated conductors 122-125, 132-135 may be limited, however, to avoid any of the isolated conductors 122-125, 132-135 from connecting to each other.

Dimensions and shapes for components of the antenna system 100 may be selected, and the antenna system 100 built, in a variety of ways. For example, a frequency of operation (e.g., radiation) for the antenna system 100 may be obtained (e.g., chosen or provided). The material for the substrate 146 is chosen. With the desired frequency and the substrate known, the distance 150 from the center of the dipole to the end of the dipole is set at about one-quarter (e.g., 22%-28%) of a wavelength in the substrate 146 at the desired frequency. A major radius, which is half of the length 106 of the major axis 107, of each of the dipole conductors 102, 104 may be set at about 9.5% (e.g., 9%-10%) of a center-frequency wavelength, i.e., the wavelength corresponding to a chosen center frequency, (e.g., about 1.023 mm or between 0.982 mm and 1.09 mm for a 27.5 GHz center frequency). The major radius may be scaled down from 1/8 of a wavelength due to the dielectric constant of the substrate 146 in some embodiments. A minor radius, which is half of the length 108 of the minor axis 109, of each of the dipole conductors 102, 104 may be set such that a ratio of the minor radius divided by the major radius about 0.3872. Thus, the minor radius may be set at about 3.6% (e.g., 3%-4%) of the center-frequency wavelength (e.g., about 0.396 mm or between 0.327 mm-0.436 mm for a 27.5 GHz center frequency). The length 106 of the major axis 107 of the dipole conductors 102, 104 may be determined such that ends near the center of the dipole conductors 102, 104 do not touch and the distance 150 of about a quarter wavelength is achieved, and the lengths 106, 108 are within 10% of similar dimensions of an ellipse.

Computer simulations may be performed (e.g., using HFSS (High Frequency Structure Simulator) software) may be performed. From the simulation(s), the angle 164 of the electric field may be determined and this angle, and desired separation of the dipole conductors from nearest isolated lobes 111, 114 and between adjacent isolated lobes 111-116, may be used to determine the sizes and shapes of the isolated lobes 111-116 such that the edges of the isolated lobes 111-116 will lie along the angle 164 from the edges of the dipole conductors 102, 104. This may be thought of as determining the locations of the edges of the isolated lobes 111-116 in order to lie along the angle 164 from the edges of the dipole conductors 102, 104. The position(s) of the edges 151-153 for the isolated lobes 111-116 (and similarly for the isolated lobes 113-116) may be selected, e.g., to be displaced from the respective energy coupler 142, 144 to inhibit interaction between the isolated lobes 111-116 and the energy couplers 142, 144 (e.g., separated by at least a minimum line width manufacturing constraint such as 50 microns or 75 microns). For example, the major radii of the isolated lobes 112, 113 and of the isolated lobes 115, 116 may each be about 4% longer than the major radius of the next-further lobe from the ground conductor 148 (i.e., the isolated lobes 111, 112, and 114, 115, respectively). Similarly, the major radii of the isolated lobes 111, 114 may each be about 4% longer than the major radius of the dipole conductor 102, 104, respectively. Thus, the major radii of the isolated lobes 111-113 and of the isolated lobes 114-116 may be about 9.7%, 10.1%, 10.5% (e.g., 8.7%-10.7%, 9.1%-11.1%, 9.5%-11.5%) respectively of the center-frequency wavelength in the substrate 146, and the minor radii of the isolated lobes 111-113 and of the isolated lobes 114-116 may be about 3.9%, 4.2%, 4.6% (e.g., 3.4%-4.4%, 3.7%-4.7%, 4.1%-5.1%) respectively of the wavelength in the substrate 146. Thus, for the example of a 27.5 GHz center frequency with dielectric constant of 1, the major radii of the isolated lobes 111-116 may be 0.95 mm-1.17 mm, 0.99 mm-1.21 mm, 1.04 mm-1.25 mm, respectively, and the minor radii of the isolated lobes 111-116 may be 0.37 mm-0.48 mm, 0.40 mm-0.51 mm, 0.45 mm-0.56 mm, respectively.

Sizes, shapes, and locations of isolated conductors may be selected. Simulated performance of the antenna system 100 with the determined sizes, shapes, and locations may be determined. One or more parameters, e.g., the length 108, the sizes, shapes, and/or locations of the isolated conductors 122-125, 132-135, and/or the shapes of the isolated lobes 111-116, may be varied and other dimensions and shapes determined and the simulated performance re-determined. Parameters yielding acceptable performance (e.g., acceptable insertion loss, return loss, directivity, and/or gain) may be set and the antenna system 100 built using known semiconductor fabrication techniques, e.g., depositing layers of substrate and conductor to yield the designed components. Continuing the example of a center frequency of 27.5 GHz, the isolated conductors 122-125 may be configured similarly to each other and to the isolated conductors 132-135, having lengths 500 (see FIG. 5) of about 1.45 mm (e.g., 1.3 mm-1.6 mm) and widths 502 (FIG. 5) of about 0.1 mm (e.g., 0.09 mm-0.11 mm) and the isolated conductors 122 may have a minimum separation 504 (FIG. 6), i.e., the smallest separation over the length of the isolated conductor 122, from the respective dipole conductor 102 of about 0.05 mm (e.g., between 0.04 mm and 0.06 mm). The minimum separation 504 may be the same for all of the isolated conductors 122-125, 132-135 and the respective dipole conductors 102, 104 and the respective isolated lobes 111-116.

Figure 11:
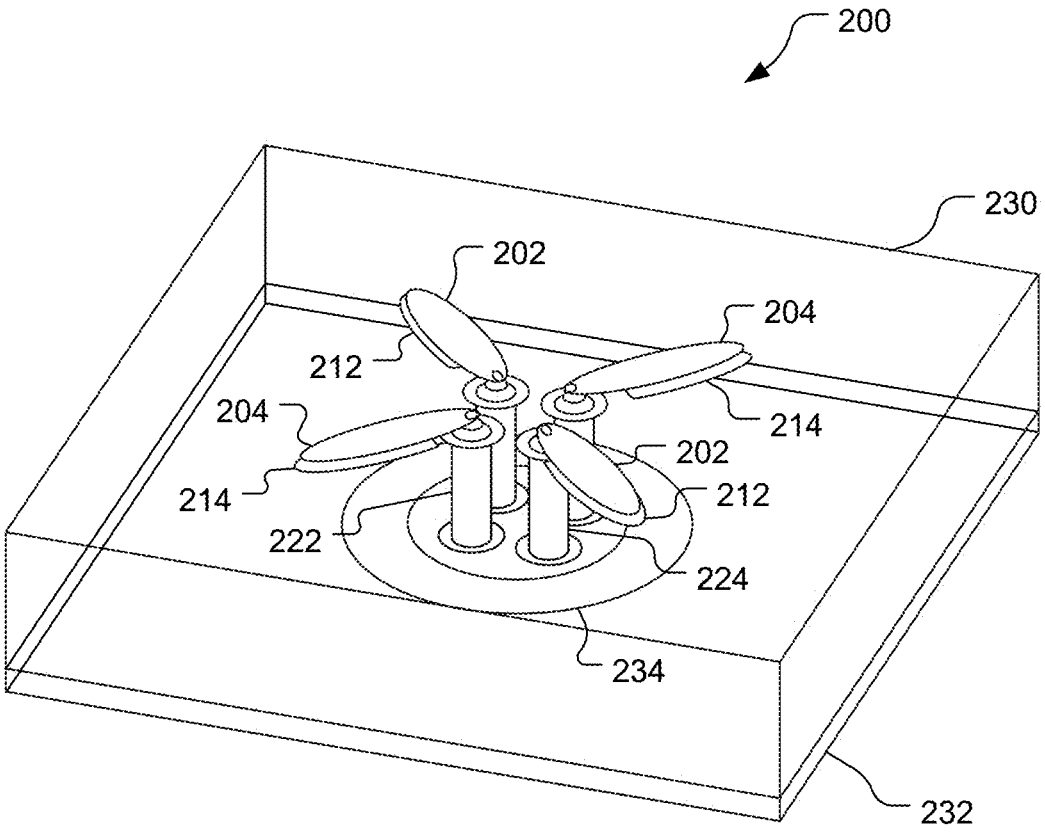
FIG. 11 is a perspective view of an alternative configuration of an antenna system that includes dipole conductors and isolated lobes.

Example Antenna System—Dipole with Isolated Lobes but without Isolated Conductors Configurations of antenna systems other than those shown and discussed with respect to the antenna system 100 may be used. For example, referring to FIG. 11, with further reference to FIGS. 4 and 5, an antenna system 200 may be used that includes items similar to some of the items in the antenna system 100. The antenna system 200 includes dipole conductors 202, 204, isolated lobes 212, 214, energy couplers 222, 224, a substrate 230 having a corresponding dielectric constant, a ground conductor 232, and a ground annular ring 234. The ground conductor 232 comprises an electrically-conductive material. The ground annular ring 234 is displaced from the ground conductor 232 by some of the substrate 230 and provides isolation for vias through which the energy couplers 222, 224 pass while not lessening a distance from the dipole conductors 202, 204 to the ground plane 232. The annular ring 234 may be used for antenna systems used for higher frequencies (e.g., 37 GHz-48.2 GHz or higher) and possibly not used for antenna systems used for frequencies lower than 37 GHz. The dipole conductors 202, 204 comprise two pairs of dipole conductors, although a single pair, e.g., the dipole conductors 202 or the dipole conductors 204 (and single pairs of corresponding isolated conductors and energy couplers), may be used. The dipole conductors 202, 204 are disposed such that at least a portion of the substrate is disposed between the ground conductor 232 and the dipole conductors 202, 204, each of the dipole conductors 202, 204 being a planar conductor. The dipole conductors 202, 204 may be planar conductors in that major surfaces of the dipole conductors 202, 204 are substantially planar. The energy couplers 222, 224 are each electrically connected to a respective one of the dipole conductors 202, 204. The isolated lobes 212, 214 comprise electrically-conductive material and are electrically separate from the dipole conductors 202, 204 and the energy couplers 222, 224. Each of the isolated lobes 212, 214 are disposed between a respective one of the dipole conductors 202, 204 and the ground conductor 232. A substantial portion, e.g., 70% or more, of a perimeter of each of the isolated lobes 212, 214 may be shaped similarly to a substantial portion, e.g., 70% or more, of a perimeter of each respective one of the dipole conductors 202, 204, the substantial portion of the isolated lobe perimeter being bigger than the substantial portion of the dipole conductor perimeter. The substantial portions of the dipole conductors 202, 204 and the isolated lobes 212, 214 may correspond to the curved portions of the isolated lobes 212, 214 and the portions of the dipole conductors 202, 204 where the dipole conductors 202, 204 and the isolated lobes 212, 214 overlap (e.g., see FIG. 5).

Figure 12:
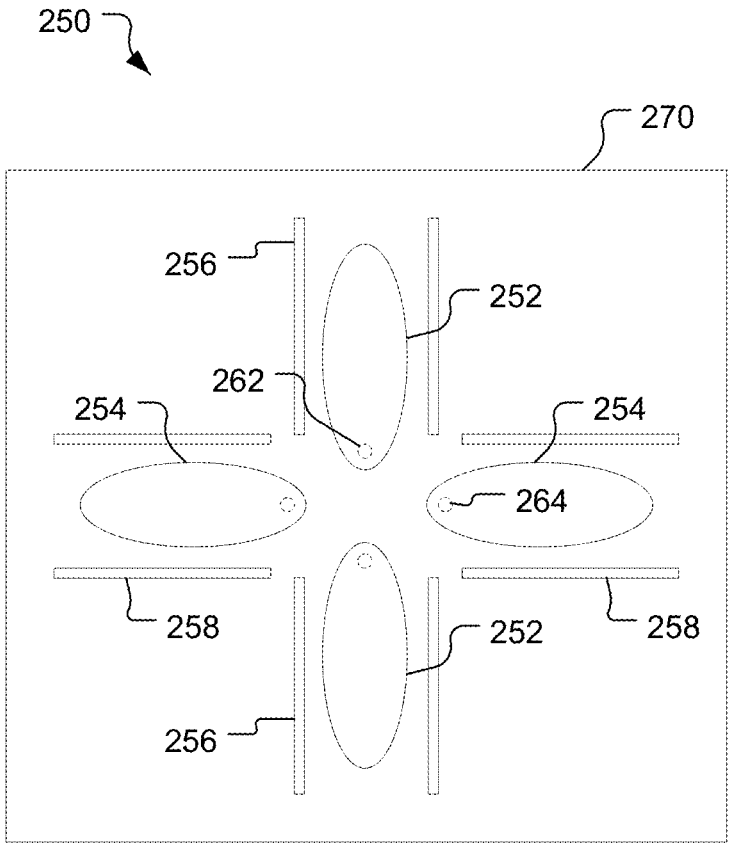
FIG. 12 is a top view of an alternative configuration of an antenna system that includes dipole conductors and corresponding isolated conductors.

Example Antenna System—Dipole without Isolated Lobes but with Isolated Conductors As another example, referring to FIG. 12, with further reference to FIGS. 4 and 5, an antenna system 250 may be used that includes items similar to some of the items in the antenna system 100. The antenna system 250 includes dipole conductors 252, 254, isolated conductors 256, 258, energy couplers 262, 264, a substrate 270 having a corresponding dielectric constant, and a ground conductor (not shown). In this example, each of the dipole conductors 252, 254 has a corresponding pair of the isolated conductors 256, 258 disposed proximate to, and laterally displaced from, the respective dipole conductor 252, 254. The isolated conductors 256, 258 in each pair of the isolated conductors 256, 258 are disposed on opposite sides of a centerline of the respective dipole conductor 252, 254.

Example Antenna System—Array

Figure 13:
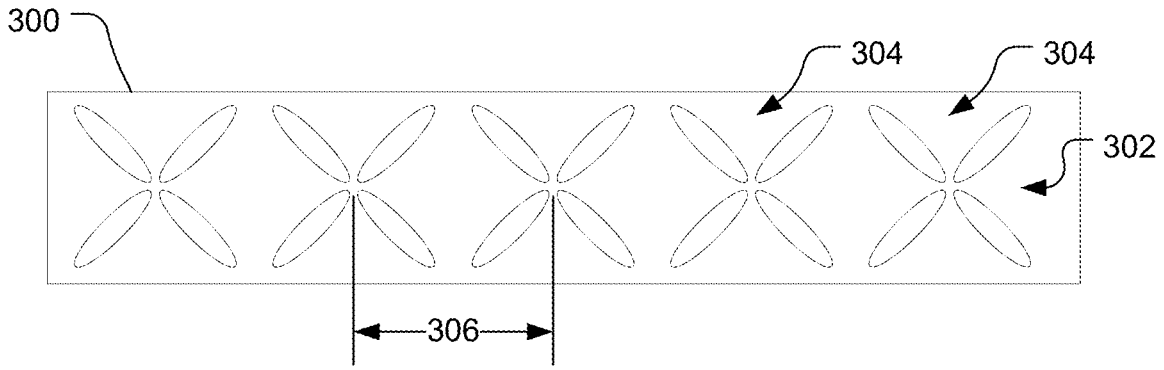
FIG. 13 is a top view of an array of antenna sub-systems.

Antenna systems discussed herein may be combined into an array of a larger antenna system. For example, as shown in FIG. 13, an antenna system 300 includes an array 302 of antenna sub-systems 304. In this example, the array 302 is a linear array and each of the antenna sub-systems 304 comprises the antenna system 100. The antenna sub-systems 304 may be disposed with a minimum separation between adjacent ones of the sub-systems to maintain cross-talk between the sub-systems 304 at an acceptable level, e.g., below a threshold level of coupling. A center-to-center spacing 306 between adjacent ones of the antenna sub-systems 304 may be about one-half of a free-space wavelength at a desired frequency.

OTHER CONSIDERATIONS

The techniques and discussed above are examples, and not exhaustive. Configurations other than those discussed may be used.

As used herein, "or" as used in a list of items prefaced by "at least one of" or prefaced by "one or more of" indicates a disjunctive list such that, for example, a list of "at least one of A, B, or C," or a list of "one or more of A, B, or C" means A or B or C or AB or AC or BC or ABC (i.e., A and B and C), or combinations with more than one feature (e.g., AA, AAB, ABBC, etc.).

The systems and devices discussed above are examples. Various configurations may omit, substitute, or add various procedures or components as appropriate. For instance, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, structures, and techniques have been shown without unnecessary detail in order to avoid obscuring the configurations. This description provides example configurations only, and does not limit the scope, applicability, or configurations of the claims. Rather, the preceding description of the configurations provides a description for implementing described techniques. Various changes may be made in the function and arrangement of elements without departing from the spirit or scope of the disclosure.

The invention claimed is:

1. An antenna system comprising:

a ground conductor comprising an electrically-conductive material;

a substrate having a dielectric constant;

a pair of dipole conductors disposed such that at least a portion of the substrate is disposed between the ground conductor and the pair of dipole conductors, each of the pair of dipole conductors being a planar conductor;

a pair of energy couplers each electrically connected to a respective one of the pair of dipole conductors; and a pair of isolated lobes comprising electrically-conductive material and being electrically separate from the pair of dipole conductors and the pair of energy couplers, each of the pair of isolated lobes being disposed between a respective one of the pair of dipole conductors and the ground conductor, a second portion of a second perimeter of each of the pair of isolated lobes being shaped similarly to a corresponding first portion of a first perimeter of each respective one of the pair of dipole conductors, the second portion of the second perimeter being disposed radially outward of the first portion of the first perimeter, wherein the second portion of the second perimeter is disposed between 1 μm and 10 μm outwardly relative to the first portion of the first perimeter.

2. The antenna system of claim 1, wherein a flare angle, normal to the first portion of the first perimeter and from a plane of the respective dipole conductor, from the first portion of the first perimeter to the second portion of the second perimeter is between 80° and 89°.

3. The antenna system of claim 1, wherein each of the dipole conductors has a major axis and a minor axis, the second perimeter being disposed outward of the first perimeter at a first end of the major axis, and the second perimeter being disposed outward of the first perimeter at opposite ends of the minor axis.

4. The antenna system of claim 1, wherein each respective dipole conductor of the pair of dipole conductors is configured to emit an electric field along the corresponding first portion of the first perimeter, of the respective dipole conductor, at a first angle relative to a first plane of the respective dipole conductor, and wherein each respective isolated lobe is configured and disposed such that the first angle is substantially equal to a second angle from the corresponding first portion of the first perimeter to the second portion of the second perimeter, relative to the first plane, in a second plane transverse to the first plane.

5. The antenna system of claim 4, further comprising a plurality of isolated proximate conductors that are electrically separate from the pair of dipole conductors, the pair of energy couplers, and the pair of isolated lobes, wherein for each member of the pair of dipole conductors and the pair of isolated lobes there is a pair of the plurality of isolated proximate conductors laterally displaced from, and disposed on opposite sides of a centerline of, the respective member.

6. The antenna system of claim 5, wherein in the second plane, each of the pair of isolated proximate conductors are laterally displaced from the respective member by a similar distance.

7. The antenna system of claim 4, wherein the pair of isolated lobes is a first pair of isolated lobes, the antenna system further comprising a second pair of isolated lobes each disposed between a respective one of the first pair of isolated lobes and the ground conductor and each having a third portion of a third perimeter shaped similarly to the second portion of the second perimeter of the respective one of the first pair of isolated lobes, and wherein the third portion of the third perimeter is disposed substantially at the second angle relative to the first plane.

8. The antenna system of claim 1, wherein the pair of dipole conductors is disposed in a first layer of the antenna system and the pair of isolated lobes is disposed in a second layer of the antenna system, the antenna system further comprising an isolated proximate conductor that is electrically separate from the pair of dipole conductors, the pair of energy couplers, and the pair of isolated lobes, and that is disposed in either the first layer of the antenna system or the second layer of the antenna system.

9. The antenna system of claim 8, wherein the isolated proximate conductor is a first isolated proximate conductor disposed in the first layer of the antenna system, the antenna system further comprising a second isolated proximate conductor disposed in the second layer of the antenna system.

10. The antenna system of claim 9, wherein each dipole conductor of the pair of dipole conductors has a length of about a quarter of a particular wavelength, wherein the first isolated proximate conductor is disposed within a tenth of the particular wavelength of a respective one of the pair of dipole conductors, and wherein the second isolated proximate conductor is disposed within the tenth of the particular wavelength of a respective one of the pair of isolated lobes.

11. The antenna system of claim 8, wherein a fourth portion of a fourth perimeter of the isolated proximate conductor has a shape similar to at least part of either the corresponding first portion of the first perimeter or the second portion of the second perimeter.

12. The antenna system of claim 8, wherein the isolated proximate conductor is rectangular.

13. The antenna system of claim 1, wherein the corresponding first portion of the first perimeter is elliptical and the second portion of the second perimeter is elliptical.

14. The antenna system of claim 1, wherein the pair of energy couplers comprises respective portions of respective coaxial transmission lines.

15. The antenna system of claim 1, wherein the pair of isolated lobes is a first pair of isolated lobes, the antenna system further comprising a second pair of isolated lobes each disposed between a respective one of the first pair of isolated lobes and the ground conductor, and wherein the second pair of isolated lobes is disposed less than one-twentieth of a particular wavelength closer to the ground conductor than the first pair of isolated lobes.

16. The antenna system of claim 15, wherein each dipole conductor of the pair of dipole conductors has a length of about a quarter of the particular wavelength and a width of about a tenth of the particular wavelength.

17. The antenna system of claim 1, wherein the pair of dipole conductors is a first pair of dipole conductors, the pair of energy couplers is a first pair of energy couplers, and the pair of isolated lobes is a first pair of isolated lobes, the antenna system further comprising:

a second pair of dipole conductors disposed orthogonally to the first pair of dipole conductors;

a second pair of energy couplers each electrically connected to a respective one of the second pair of dipole conductors; and a second pair of isolated lobes comprising electrically-conductive material and being electrically separate from the second pair of dipole conductors and the second pair of energy couplers, each of the second pair of isolated lobes being disposed between a respective one of the second pair of dipole conductors and the ground conductor.

18. The antenna system of claim 17, wherein each dipole conductor of the second pair dipole conductors is shaped similarly to each dipole conductor of the first pair of dipole conductors.

19. The antenna system of claim 17, further comprising:

a first plurality of isolated proximate conductors that are electrically separate from the first pair of dipole conductors, the first pair of energy couplers, and the first pair of isolated lobes, wherein for each member of the first pair of dipole conductors and the first pair of isolated lobes there is a pair of the first plurality of isolated proximate conductors laterally displaced from, and disposed on opposite sides of a centerline of, the respective member; and a second plurality of isolated proximate conductors that are electrically separate from the second pair of dipole conductors, the second pair of energy couplers, and the second pair of isolated lobes, wherein for each member of the second pair of dipole conductors and the second pair of isolated lobes there is a pair of the second plurality of isolated proximate conductors laterally displaced from, and disposed on opposite sides of a centerline of, the respective member.

20. The antenna system of claim 19, wherein each of the first plurality of isolated proximate conductors and each of the second plurality of isolated proximate conductors is separate from every other isolated proximate conductor of the first plurality of isolated proximate conductors and every other isolated proximate conductor of the second plurality of isolated proximate conductors.

* * * * *